US005975159A

United States Patent [19]

Persenaire et al.

[11] Patent Number: 5,975,159

[45] Date of Patent: Nov. 2, 1999

[54] CONTAINER FILLER APPARATUS EXTERNAL DISCONNECT VALVE

[75] Inventors: Jeffrey M. Persenaire, Hudsonville; Robert B. Szabo, II, Allegan, both of Mich.

[73] Assignee: Fogg Filler Company, Holland, Mich.

[21] Appl. No.: 08/926,351

[22] Filed: Sep. 9, 1997

[51] Int. Cl.[6] ..... B65B 1/04

[52] U.S. Cl. ..... 141/145; 285/318; 285/81

[58] Field of Search ..... 141/144–152, 141/290, 291; 285/318, 305, 81

[56] References Cited

U.S. PATENT DOCUMENTS

| | | | |
|---|---|---|---|
| 2,226,826 | 12/1940 | Miller | 285/167 |
| 2,455,544 | 12/1948 | Yonkers | 285/169 |
| 2,784,885 | 3/1957 | Kneisley | 222/439 |
| 2,846,240 | 8/1958 | Beyer | 285/5 |
| 2,914,344 | 11/1959 | Anthes | 285/93 |
| 3,176,731 | 4/1965 | Minard | 141/295 |
| 3,289,712 | 12/1966 | Smith | 141/295 |
| 3,532,101 | 10/1970 | Snyder | 137/75 |
| 3,756,290 | 9/1973 | Cleland | 141/5 |
| 4,593,838 | 6/1986 | Oberbach | 222/607 |
| 4,678,210 | 7/1987 | Balsells | 285/318 |
| 4,700,756 | 10/1987 | Minard | 141/144 |
| 4,783,100 | 11/1988 | Klein | 285/276 |
| 4,872,710 | 10/1989 | Konecny | 285/81 |
| 4,906,031 | 3/1990 | Vyse | 285/318 |
| 5,002,318 | 3/1991 | Witter | 285/302 |
| 5,115,836 | 5/1992 | Carrow | 137/614 |
| 5,209,262 | 5/1993 | Carow | 137/614 |
| 5,226,682 | 7/1993 | Marrison | 285/308 |
| 5,342,095 | 8/1994 | Klinger | 285/18 |
| 5,433,247 | 7/1995 | Guertin | 137/614 |
| 5,492,371 | 2/1996 | Szabo | 285/23 |
| 5,570,719 | 11/1996 | Richards | 137/614 |
| 5,615,706 | 4/1997 | Guertin | 137/614 |

OTHER PUBLICATIONS

*Bulletin No. 45*, The Fogg Ventraflow Valve, (No Date).

*Primary Examiner*—Steven O. Douglas
*Attorney, Agent, or Firm*—Price, Heneveld, Cooper, DeWitt and Litton

[57] ABSTRACT

Container filler apparatus having a bowl for receiving liquid and for dispensing the liquid into a multiple of containers, a plurality of liquid-outlet lower openings and collars depending from the bowl, a plurality of liquid-outlet control valve mechanisms cooperatively interfitted within respective ones of the collars, a distortable retainer spring between each valve mechanism and its respective collar for retaining the valve in its collar, and safety clips exterior of said bowl engaged between the valves and their respective collars whereby each said valve mechanism can be removed from the bowl solely at the exterior of the bowl by removing the safety clip and pulling the valve down a sufficient amount to release the retainer spring. The retainer spring is an annular canted coil spring. An annular seal is between each valve mechanism and its respective collar, adjacent to but spaced from the canted coil spring.

6 Claims, 4 Drawing Sheets

CONTAINER FILLER APPARATUS EXTERNAL DISCONNECT VALVE

BACKGROUND OF THE INVENTION

This invention relates to container filler apparatus, particularly apparatus for filling consecutive containers with flowable material, typically liquid, especially edible liquids such as milk, juice, water and the like.

Apparatuses of this type have a large filler bowl containing a quantity of liquid capable of filling many advanced containers such as bottles. Typically the bowl possesses a substantial number of underside depending valves per machine, usually ranging between 1 and 100 valves. These valves must be removed from the bowl fairly often for cleaning, maintenance and inspection, especially if dispensing dairy products and/or if changing from one type and/or flavor of product to another type and/or flavor of product. In fact, the dairy industry may remove the valves one or more times per day for cleaning and inspection, followed by replacement of the valves. To remove, clean and replace these valves on currently available filler apparatuses is a substantial time and labor consuming operation. The valves must be individually disconnected at the inside of the large bowl. Specifically, all current machines in the industry require removal of an internal retainer at the inside bottom of the filler bowl for each valve, to allow removal of the valve from the filling machine. To perform this removal, the bowl must first be emptied of product, and the bowl lid or cover removed or lifted to allow access to the valve internal retainers. The machine operator must then reach down inside the bowl and remove each valve retainer as the operator or another person holds the valve assembly from the outside of the bowl to prevent the valve from falling out of the machine. Since gravity fillers often have anywhere from 6 to 56 valves per machine as noted, this process of valve removal for all the valves is cumbersome and time consuming, but the filling industry has accepted it for years for lack of an alternative.

To reinstall valves in the presently available machines, the valve assemblies must be inserted up through the filler bowl, and then rest the valve on the machine lifter. The operator then has to climb up and reach into the filler bowl, pull the valve assembly further into place and lock it in place with the internal retainer, all from the inside of the bowl. The bowl cover or lid is then placed back on the bowl. When the bowl lid or cover is lifted or removed, the bowl must be resanitized prior to filling with product.

SUMMARY OF THE INVENTION

This present invention provides a significant change in the valve and bowl assembly of the filling machine, enabling all valves to be quickly and easily removed from the outside of the bowl. There is no need to reach down into the bowl interior. With the bowl empty of product, all the operator needs to do is slide an external safety clip from the valve receiver, gently pop the valve assembly out of the depending bowl valve flange, and lower the valve, all from the outside of the bowl. This is easily accomplished with one hand, leaving the other hand free to hold and guide the valve assembly out of the machine.

Furthermore, to reinstall the novel valves, the operator need only push each valve assembly up into the bowl weldment collar, typically called a valve flange, thereby causing a retainer spring to snap into and nest in a depression in the valve flange to secure the valve assembly. For safety purposes, the operator then slides an external safety clip into grooves of the nested assembly. Removal and replacement of the valve are both accomplished completely from the outside of the filling machine. The assembly is then ready to again fill containers with selected product.

The novel quick change valve assembly meets FDA 3A dairy standards for material, contour and finish. The valve uses a canted coil retainer spring. This spring is isolated from the product flow path by an O-ring seal. The retainer spring nests in an outer diameter depression and an inner diameter groove, capturing the valve components together. Down time is greatly reduced, making filler machine changeover much more efficient, safer, and easier to accomplish.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
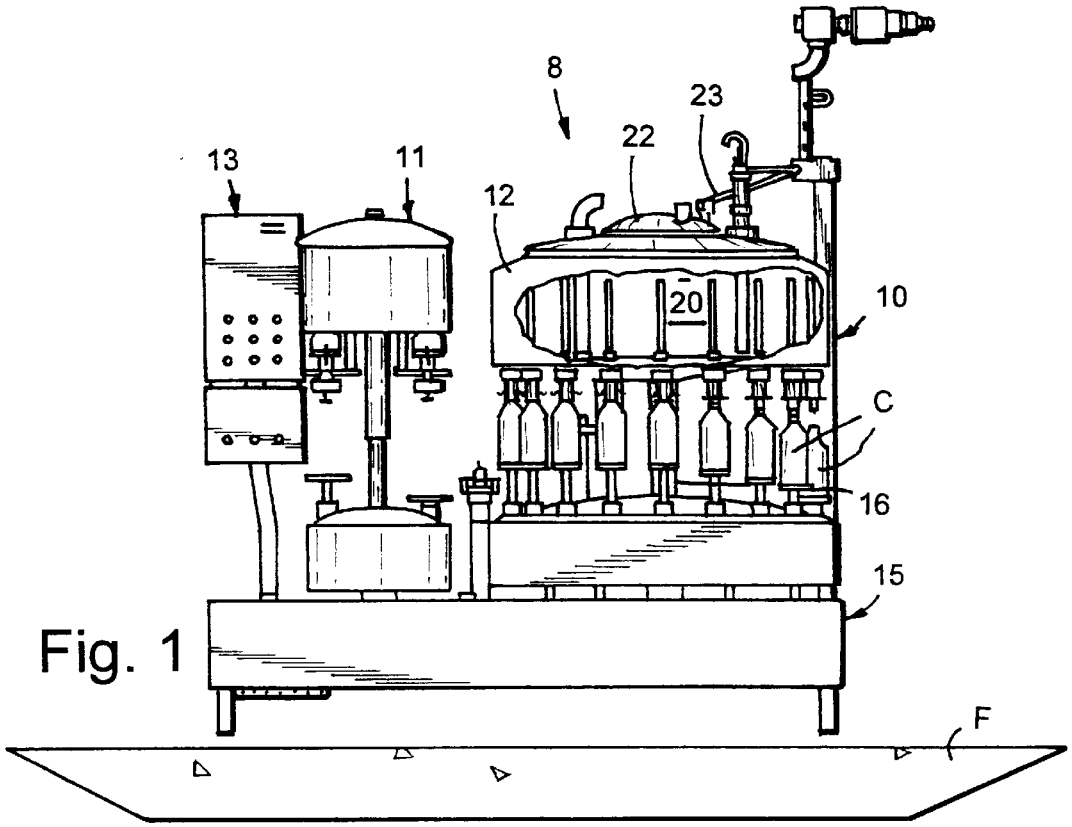
FIG. 1 is an elevational view of a filler apparatus of this invention.

Referring now specifically to the drawings, in FIG. 1 is shown a filling and capping apparatus 8 including a filler assembly 10, a capping assembly 11, a control panel 13, and a support base 15. The control panel, capping station and support base are of conventional type. They all rest on floor F.

Filler assembly 10 includes a large elevated filler bowl 12. It has an open top which can be enclosed by bowl lid or cover 22 attached to bracket 23. Inside the bowl is a large cavity 20 for receiving a substantial amount, typically several gallons, of a chosen liquid with which a plurality of containers are to be filled. Bowl 12 is supported on a central rotational column 16. Extending around the periphery in the bottom of bowl 12 are a plurality of openings 14 (FIG. 2), usually from about 6 to 56 in number, spaced radially equally from the center of the cylindrical bowl.

Figure 2:
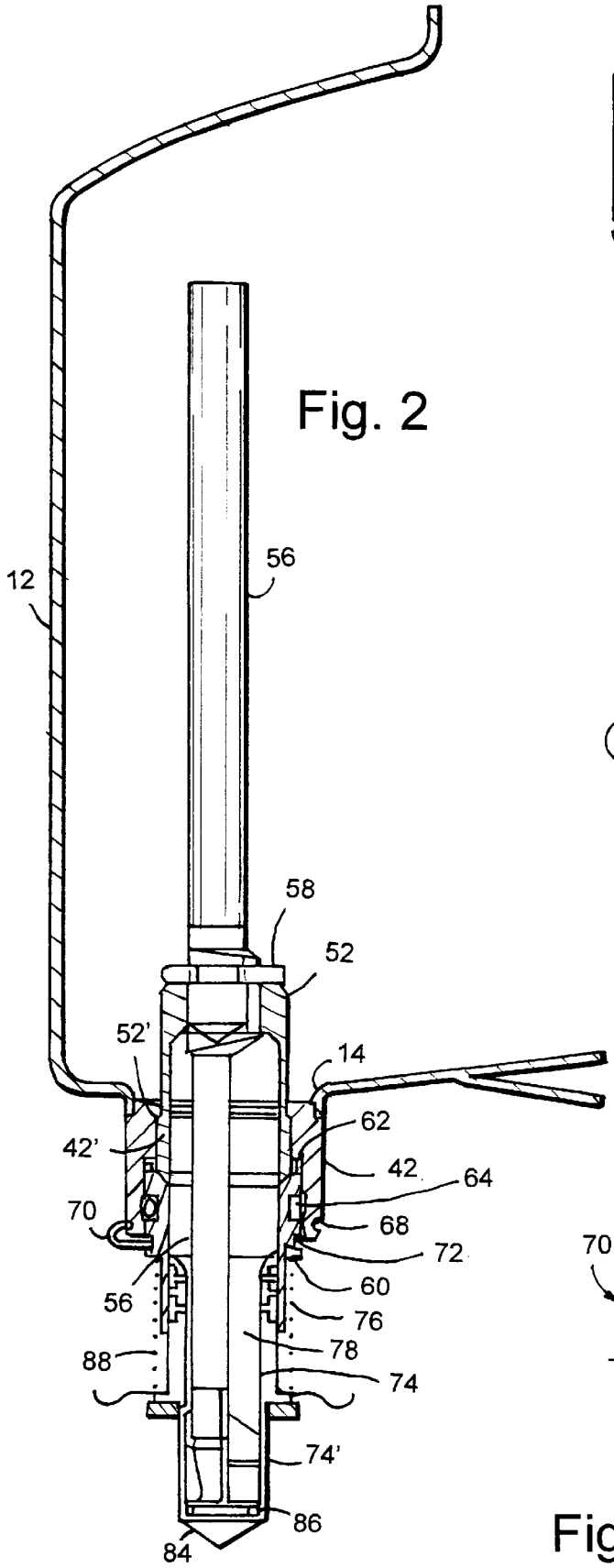
FIG. 2 is an enlarged fragmentary sectional view of a portion of the filler apparatus in FIG. 1, showing the novel assembly for one valve.

Referring now to FIG. 2, each of the openings 14 in the bottom of bowl 12 has mounted therein a depending, generally cylindrical valve flange 42 in the form of an annular elongated collar. This collar is preferably integrally secured to the bowl by welding. Extending through the center of each collar 42 is a central opening 44 (FIG. 4) through which a control valve mechanism extends (FIG. 2), and in which the valve mechanism is mounted. This valve mechanism 50 employs a cylindrical stabilizer 52 (FIG. 2). The lower end of this stabilizer is received within collar 42, and has a radially outwardly extending circumferential shoulder 52' which abuts against a radially inwardly extending circumferential shoulder 42' at the upper end of collar 42. These interfitting shoulders limit the upward movement of the valve mechanism when being inserted up into the bowl, and specifically the central opening of collar 42, to the fully installed position depicted in FIG. 2. Extending through stabilizer 52 and connected to the upper end of stabilizer 52 is a vent tube 56 of standard type. It extends upwardly toward the top portion of bowl 20 and down to the bottom of the valve mechanism to allow ambient air to escape the container being filled and to enter the bowl and replace liquid which is being dispensed. The connection of vent tube 56 with stabilizer 52 is by an assembly clip 58.

Figure 4:
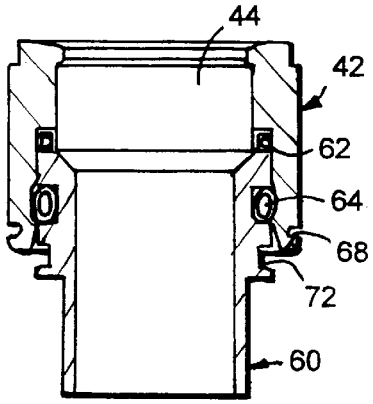
FIG. 4 is an enlarged sectional view of a portion of the valve receiver retained in the valve flange.
Figure 7:
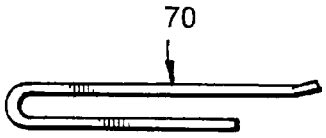
FIG. 7 is an elevational view of the safety clip preferably forming part of the assembly.
Figure 8:
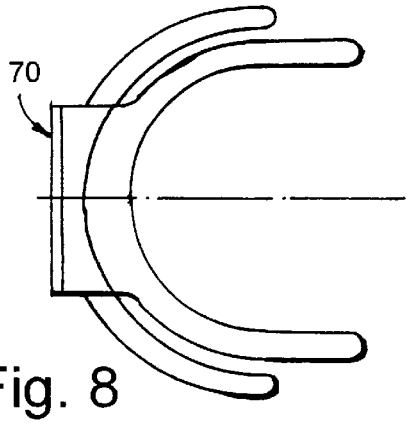
FIG. 8 is a plan view of the safety clip in FIG. 7.
Figure 3D:
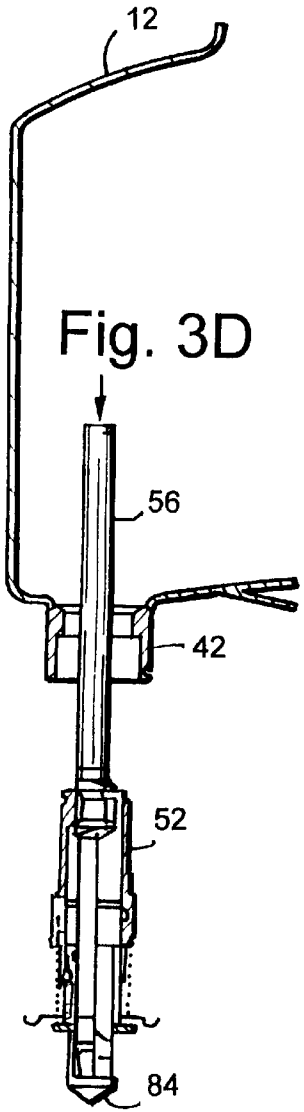
FIG. 3 is a series of FIGS. 3A–3D showing the sequence of removal of the novel valve mechanism from the bowl.
Figure 3C:
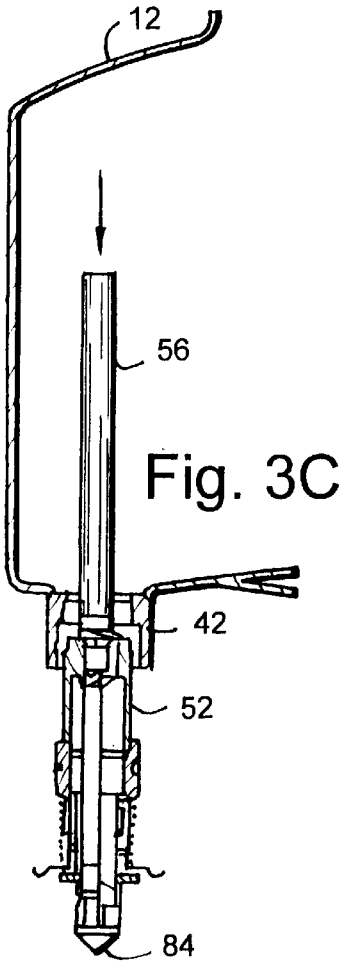
Figure 3B:
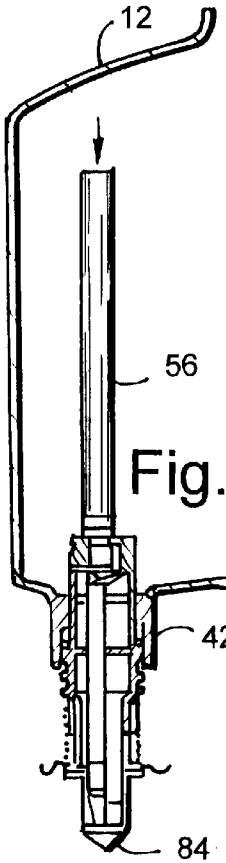
Figure 3A:
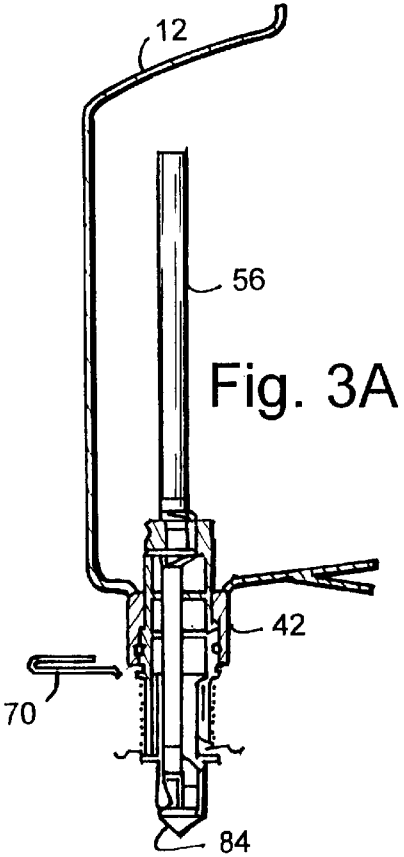
Figure 11:
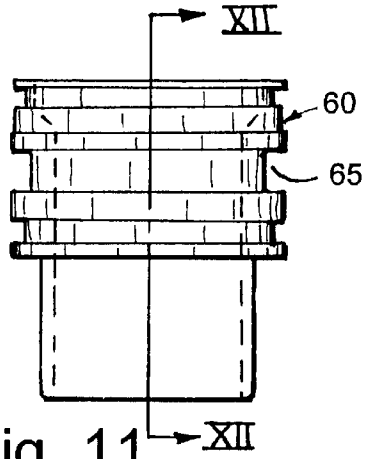
FIG. 11 is an elevational view of a portion of the valve mechanism.
Figure 12:
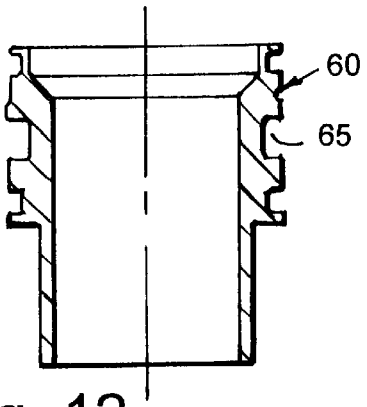
FIG. 12 is a sectional view taken on plane XII—XII of FIG. 11.
Figure 10:
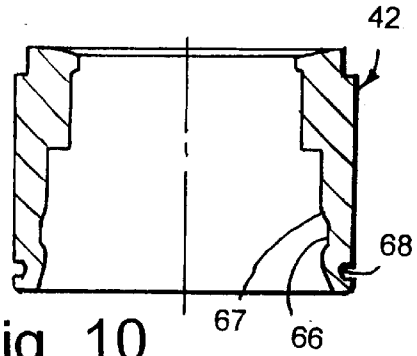
FIG. 10 is a sectional view taken on plane X—X of FIG. 9.
Figure 9:
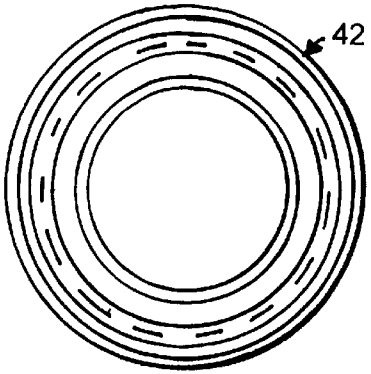
FIG. 9 is a bottom view of the valve flange.

Connected to and depending from the lower end of stabilizer 52 is a valve receiver 60 which is a sleeve generally cylindrical in configuration. At the upper end of valve receiver 60 is an annular O-ring seal 62 of polymer. This seal prevents liquid from migrating from the interior of bowl 20 down around the outer periphery of receiver 60. Below seal 62 is an annular retainer spring 64 of the canted coil type as in U.S. Pat. No. 4,678,210. The spring is held in an annular groove 65 in the outer periphery of receiver 60 (FIGS. 11 and 12). The inner diameter of collar 42 also contains an annular depression 43 aligned with the annular groove 65 of valve receiver 60 when the valve assembly is fully inserted into the valve flange, such that the canted coil spring 64 can radially expand into this shallow depression 67 and thereby retain the valve receiver within the collar 42. Just beneath depression 67 in the collar is a radially inwardly extending shoulder 66 (FIG. 10) which is tapered, i.e., sloped, on the lower side and on the upper side. The taper surface on the lower side of the shoulder enables the canted retainer spring to be deformed temporarily against its inherent bias, i.e., deformed radially inwardly during forced insertion of the valve receiver up into the collar 42 until the groove 65 and the depression 67 are aligned with each other, at which position the spring re-expands radially outwardly. The tapered surface on the upper portion of the shoulder biases the spring radially inwardly when the valve mechanism is pulled downwardly, to enable the valve receiver to be pulled downwardly out of the collar 42 by causing temporary distortion radially inwardly of retainer spring 64 during disassembly. After release of the valve mechanism from the collar 42, spring 64 re-expands radially outwardly. While the valve mechanism is still in place in collar 42, valve receiver 60 is safety secured by a special exterior safety clip 70 which extends through parallel exterior grooves 68 and 72 on collar 42 and valve receiver 60 respectively (FIGS. 2 and 4). Safety clip 70 has a general U-shape (FIGS. 7 and 8) with bifurcated spring legs on both the upper portion and the lower portion of the clip. These legs engage the opposite sides of both respective grooves to prevent the valve mechanism from inadvertently being forced out of the collar 42.

The center portion of the valve mechanism and its liquid release and stoppage components are basically conventional. These include a cylindrical valve sleeve 74 having its upper portion extending upwardly into valve receiver 60, and having a peripheral annular seal 76 in a groove around the valve sleeve to seal between the valve sleeve and valve receiver 60, and allow fluid flow to be only down through the central passageway 78 of the valve sleeve. The lowermost portion of valve sleeve 74 protrudes below valve receiver 60 in the form of a smaller diameter inserting nozzle 74' which can project down into the opening and neck of a container C to be filled. Around the upper portion of nozzle 74' is an annular valve lip seal 80 to engage the top surface of a container C. At the bottom end of nozzle 74' is the valve 84 itself, having an O-ring seal 86 therearound for closing the valve until the nozzle 74' is inserted inside of a container C which is being elevated far enough to cause the container top to be pressed against annular valve lip seal 80. Further elevation of the container at that point will cause the container, pressing upwardly on valve lip seal 80, to compress elongated compression coil spring 88, thereby enabling nozzle 74' and valve 84 to be inserted into the container C and valve 84 to protrude out of nozzle 74' to open the nozzle for flow of the dispensed liquid down through the central passage tube 78 into the container, and air to be flushed out of the container up through the vent tube 56 into bowl 12. As the container reaches the full level, the container is lowered by the rotary unit so that the valve is caused to close by the bias of coil spring 88.

Beneath the bowl is a rotary unit 30 which is rotational with the bowl to advance its multiple of equally spaced support pads 32 and containers C circumferentially with simultaneous like movement of bowl 20. Each support pad is vertically aligned with a valve mechanism. Thus, support pads 32 are also at radially equal distances from the center of rotary support 30. These container support pads 32 are controllably elevatable and lowerable by conventional actuators (not shown) beneath the support pistons 32' for pads 32.

Figure 5:
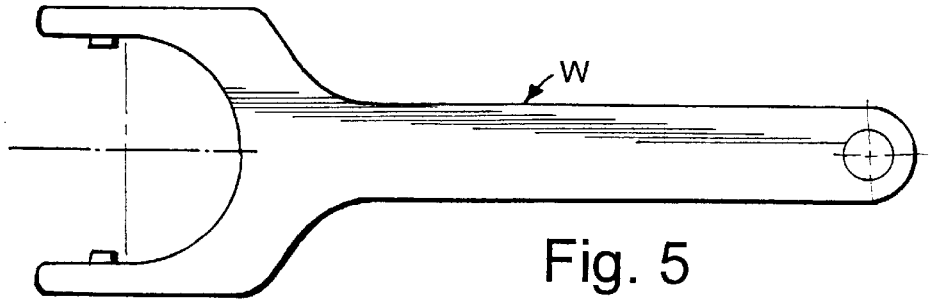
FIG. 5 is a plan view of a preferred valve removal tool.
Figure 6:
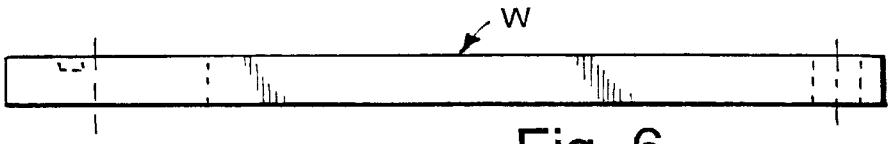
FIG. 6 is a side elevational view of the tool in FIG. 5.

When it is desired to remove the valve mechanisms from the bowl for cleaning, maintenance, and/or replacement, the task is simple because of the present invention. Once the bowl is empty, exterior safety clip 70 is slid off the exterior of a valve assembly, from the outside of the bowl, the valve assembly is gripped with one hand and pulled downwardly, causing retainer spring 64 to be temporarily radially inwardly distorted to pass the adjacent shoulder 66, and the valve is lowered through the sequence of steps depicted in FIGS. 3A–3D to remove it. Sometimes it may be desirable to employ a spanner wrench W as in FIGS. 5 and 6 to help release the valve mechanism by forcing it downwardly. The mechanism so removed may be disassembled, inspected, and/or cleaned as desired. When a valve mechanism is to be replaced, the operator need only insert the valve assembly, with vent tube 56 being first, and stabilizer 52 next, up through the opening in collar 42 until retention spring 64 engages the lower sloped surface of the shoulder 66. With a vertical push on the mechanism, spring 64 is radially inwardly distorted, and then subsequently snaps back out into place in the annular depression 67. For security reasons, safety clip 70 is inserted through the respective grooves 68 and 72 of the lower end of collar 42 and the enlarged portion of valve receiver 60. This same installation action is employed for each of the valve mechanisms inserted into the bowl valve flanges, i.e., collars, around the periphery of the bowl. The apparatus is then ready for use to fill a plurality of containers, typically bottles, which are advanced on support pads 32, elevated by pistons 32' into filling arrangement with the valves, and then lowered after being filled so as to be subsequently capped by conventional capping device 11.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

What is claimed is:

1. Container filler apparatus comprising:

a bowl for receiving flowable material and for dispensing the material into a multiple of containers;

a plurality of lower outlets having openings from said bowl;

said outlets having respective valve collars depending from said bowl at said openings;

a plurality of outlet control valve mechanisms cooperatively interfitted within respective ones of said collars;

a distortable retainer spring between each said valve mechanism and its respective collar for retaining each valve mechanism in its collar;

safety clips exterior of said bowl engaged between said valve mechanisms and their respective collars, whereby each said valve mechanism can be removed from said bowl solely at the exterior of said bowl by removing said safety clip and pulling said valve mechanism a sufficient amount to release said retainer spring; said collar and said valve mechanism having exterior grooves to receive one of said safety clips; and said safety clips having a generally U-shape, each portion of the U having a pair of bifurcated legs to engage said exterior grooves.

2. The apparatus in claim 1 wherein said retainer spring is an annular canted coil spring.

3. The apparatus in claim 1 including a seal between each said valve mechanism and its respective collar.

4. The apparatus in claim 2 including an annular seal between each said valve mechanism and its respective collar, spaced above said canted coil spring.

5. The apparatus in claim 4 wherein said valve mechanism has an annular groove retaining said canted coil spring, and said collar has an annular depression for receiving said canted coil spring.

6. The apparatus in claim 5 wherein said collars have sloped shoulders for biasing said canted coil springs radially inwardly during insertion and removal of said valve mechanism to and from said collars.

* * * * *